US008727734B2

(12) United States Patent
Xiao et al.

(10) Patent No.: US 8,727,734 B2
(45) Date of Patent: May 20, 2014

(54) BLADE RETAINER CLIP

(75) Inventors: Xinwen Xiao, San Diego, CA (US); Shiv C. Gupta, San Diego, CA (US); Venkata S. Bandaru, Manchester, CT (US); Gordon F. Jewess, San Diego, CA (US); Davin Hansen, Vista, CA (US)

(73) Assignee: Pratt & Whitney, East Hartford, CT (US)

( * ) Notice: Subject to any disclaimer, the term of this patent is extended or adjusted under 35 U.S.C. 154(b) by 616 days.

(21) Appl. No.: 12/781,510

(22) Filed: May 17, 2010

(65) Prior Publication Data

US 2011/0280731 A1 Nov. 17, 2011

(51) Int. Cl.
*F01D 5/32* (2006.01)

(52) U.S. Cl.
USPC ..... 416/220 R

(58) Field of Classification Search
CPC ..... F01D 5/02; F01D 5/30; F01D 5/3007; F01D 5/3053; F01D 5/32; F01D 5/323
USPC ..... 416/221, 220 R, 219 R, 204 R, 205, 206
See application file for complete search history.

(56) References Cited

U.S. PATENT DOCUMENTS

| | | | | |
|---|---|---|---|---|
| 3,076,634 | A * | 2/1963 | Boyle et al. | 416/221 |
| 4,395,827 | A | 8/1983 | Stowe et al. | |
| 4,480,959 | A | 11/1984 | Bourguignon et al. | |
| 4,711,007 | A * | 12/1987 | Conrad | 29/889.21 |
| 6,416,286 | B1 * | 7/2002 | Roberts et al. | 416/191 |
| 6,419,452 | B1 * | 7/2002 | Frosini et al. | 416/221 |
| 8,287,238 | B2 * | 10/2012 | Dimascio et al. | 416/170 R |
| 2008/0286106 | A1 | 11/2008 | Keith et al. | |
| 2009/0053064 | A1 | 2/2009 | Ress, Jr. | |
| 2009/0060746 | A1 * | 3/2009 | Barr et al. | 416/221 |

* cited by examiner

*Primary Examiner* — Nathaniel Wiehe
*Assistant Examiner* — Jeffrey A Brownson
(74) *Attorney, Agent, or Firm* — Stephen G. Mican

(57) ABSTRACT

A blade retainer clip for retaining a foot of a turbine blade in a shoe of a turbine disc of a turbine wheel includes: a clip shank that fits into a mating slot in the blade foot; a protuberance along a central portion of the clip shank that fits into a mating recess along the mating slot in the blade foot; a clip heel on one end of the clip shank that engages a heel of the blade foot and a heel of the disc shoe that expands radially from at least opposite sides of the clip shank; and a clip toe that extends beyond a toe of the disc shoe that is deformable to contact at least the toe of the disc shoe.

9 Claims, 6 Drawing Sheets

BLADE RETAINER CLIP

Figure 1:
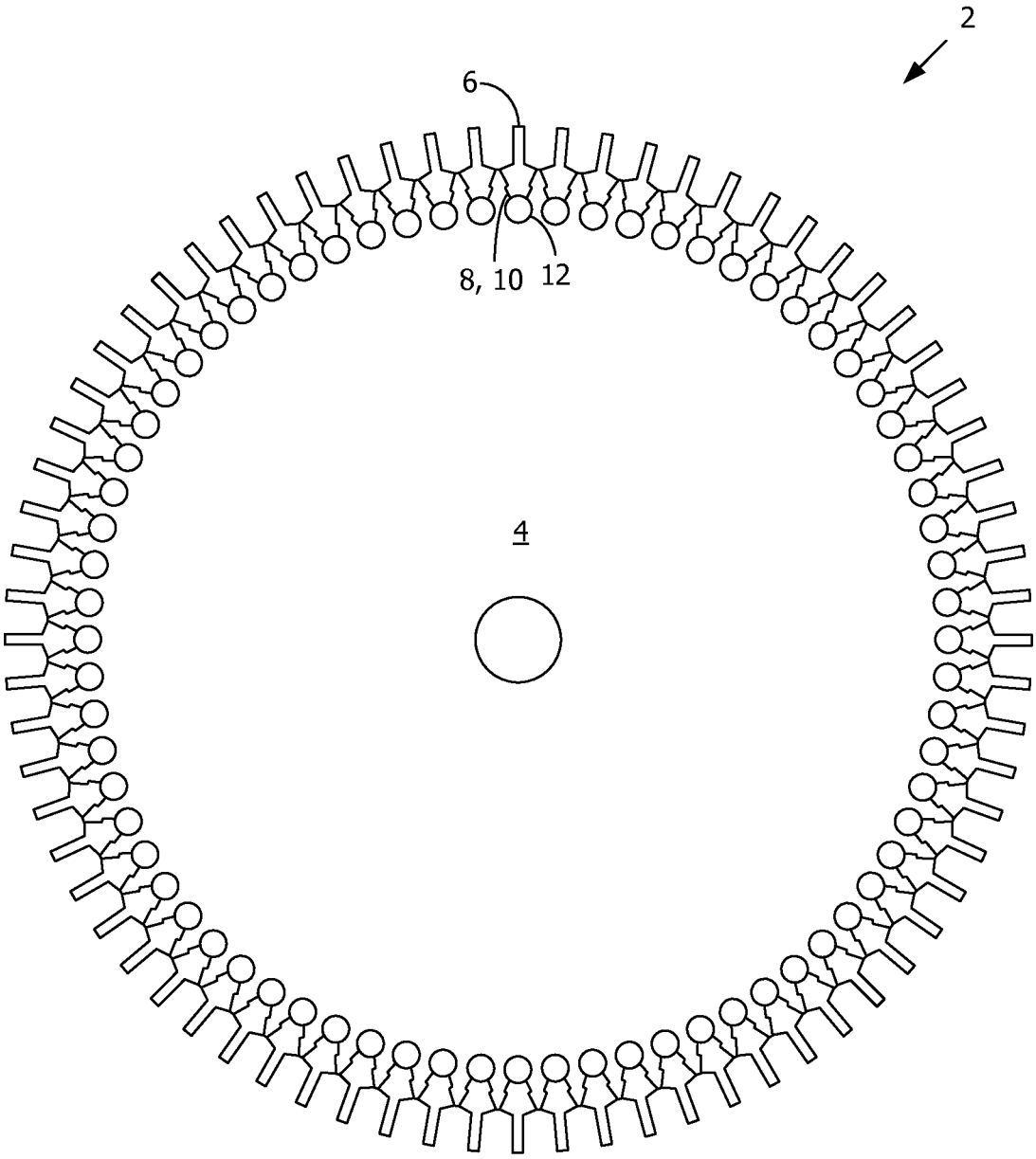
Figure 2:
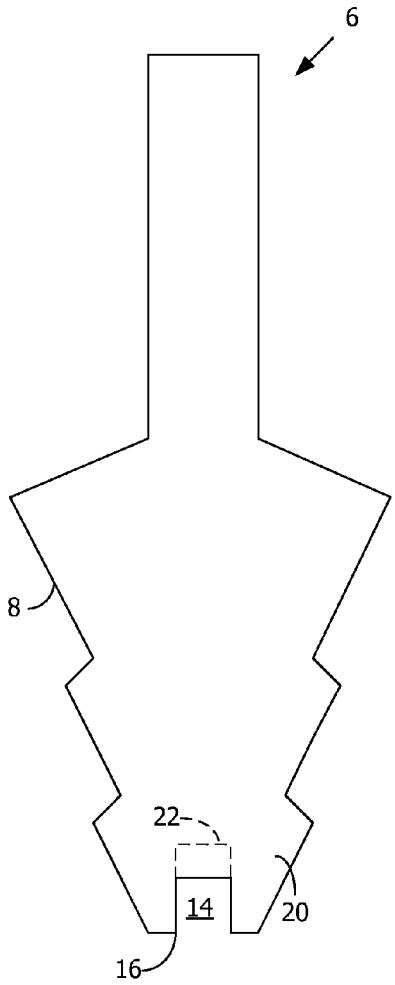
Figure 3:
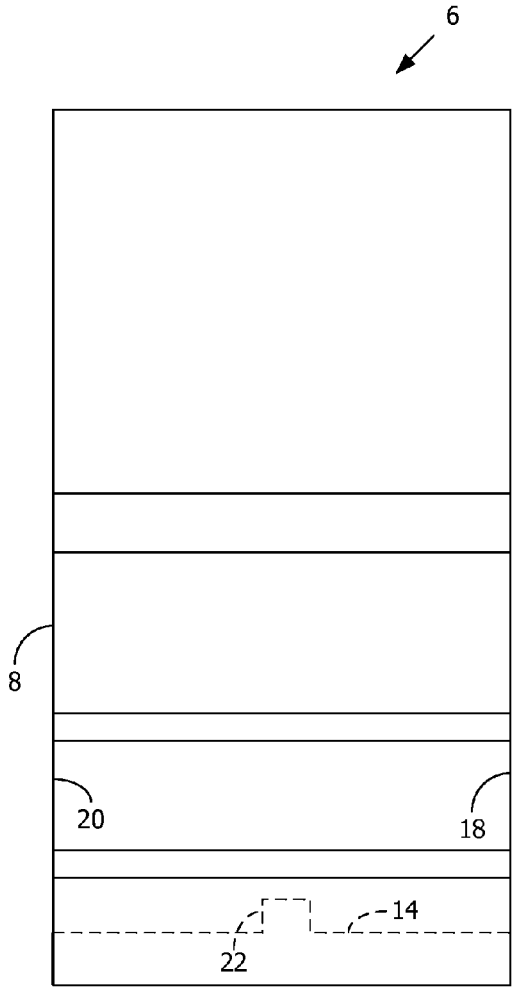
Figure 4:
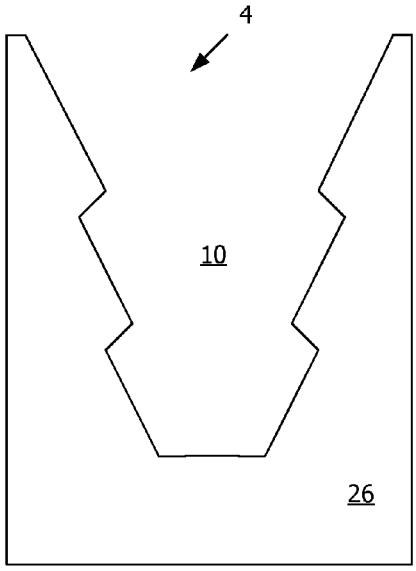
Figure 5:
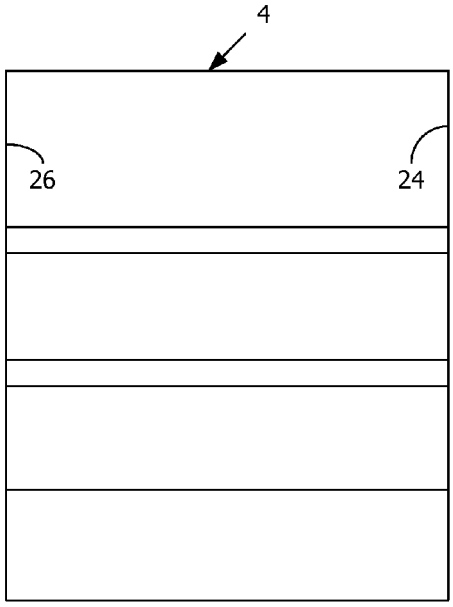
Figure 6:
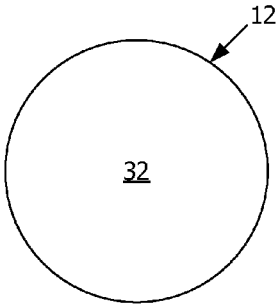
Figure 7:
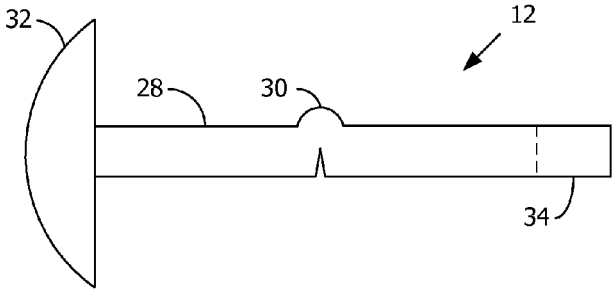
Figure 8:
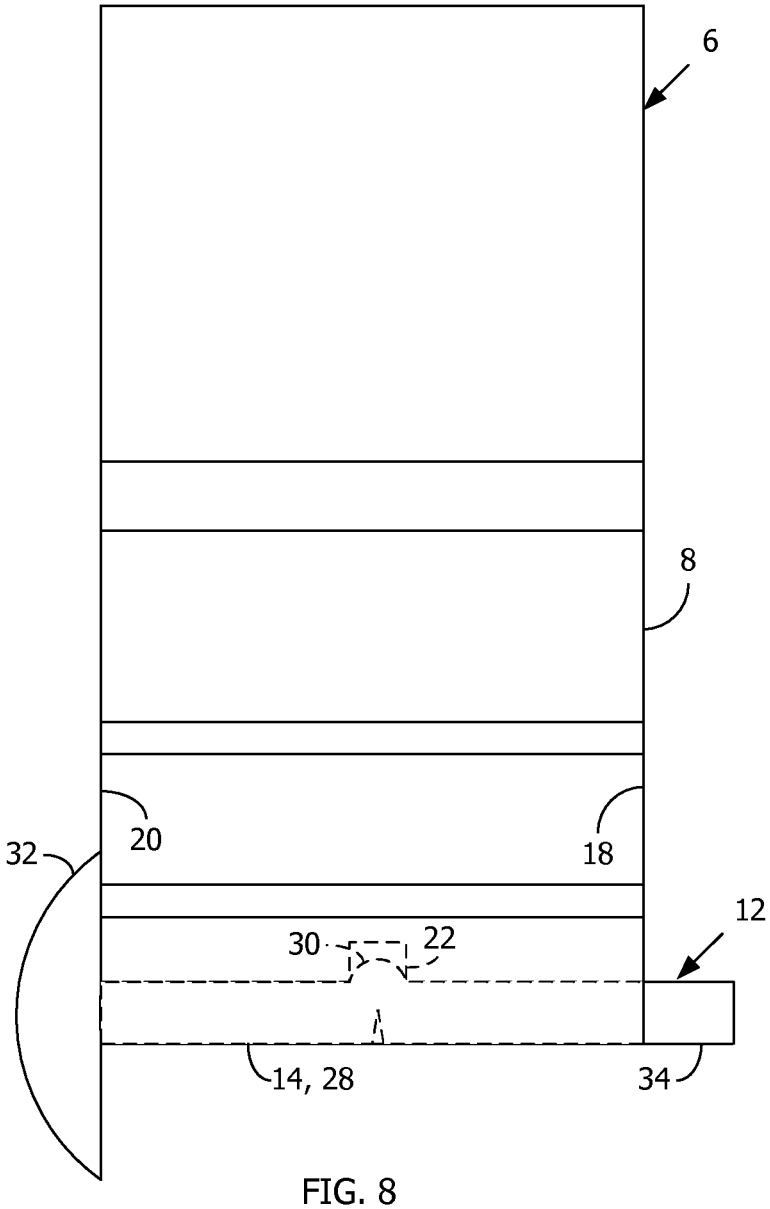
Figure 9:
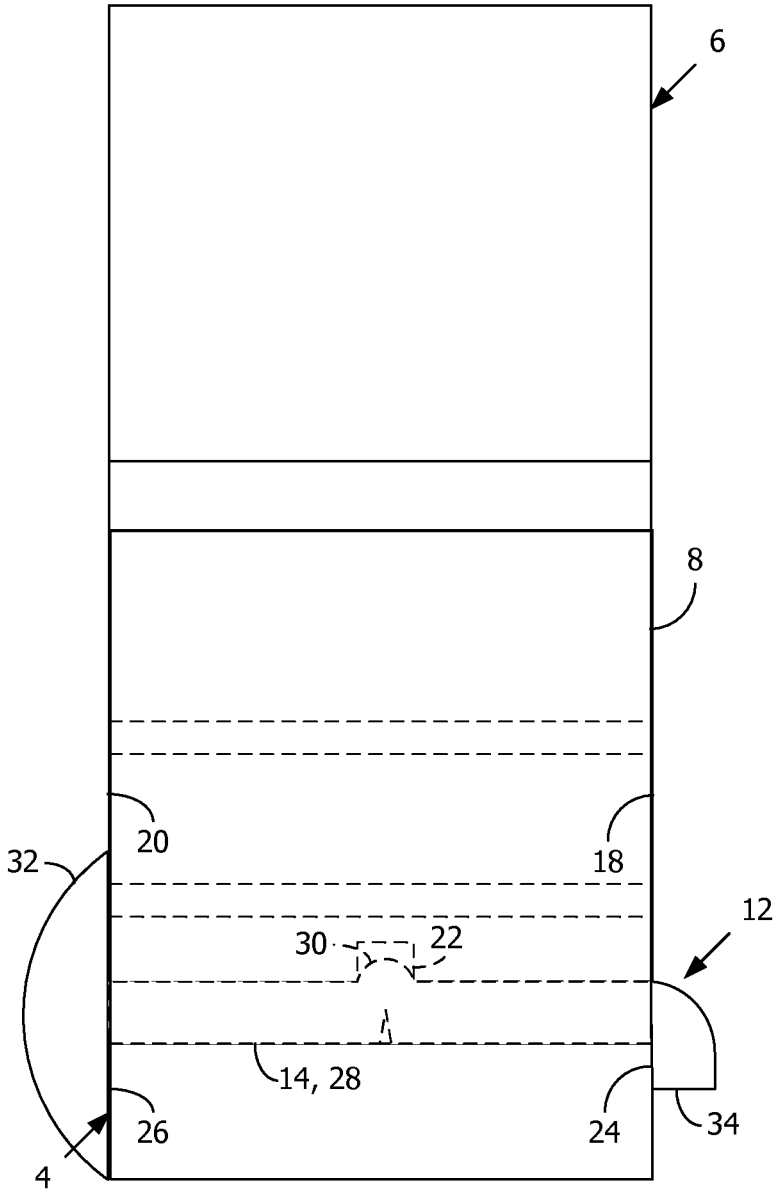
Figure 10:
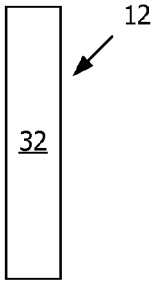
Figure 11:
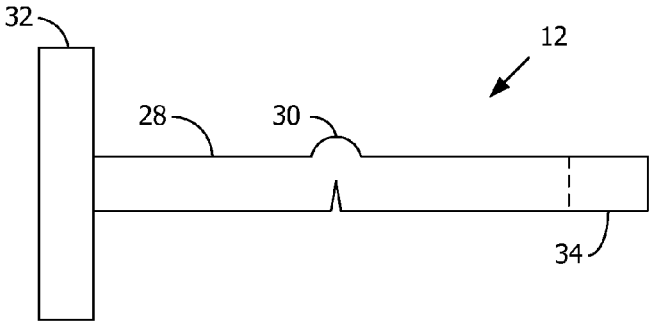
Figure 12:
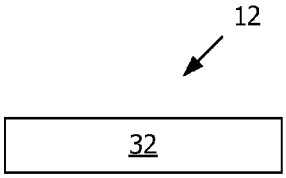
Figure 13:
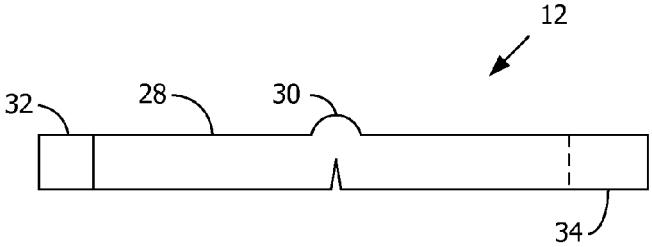
Figure 14:
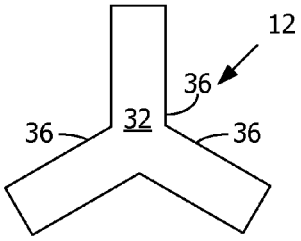
Figure 15:
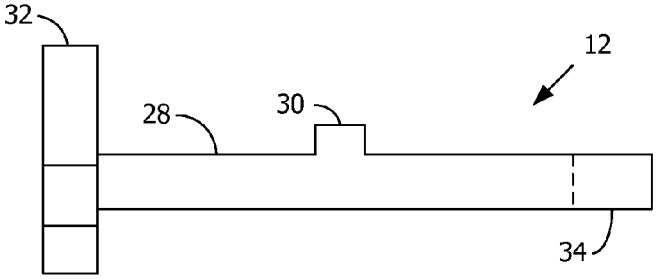

FIG. 1 is an end view of a turbine wheel that may incorporate at least one possible embodiment. FIGS. 2 and 3 are end and side views of a turbine blade for the turbine wheel of FIG. 1. FIGS. 4 and 5 are partial end and side views of a turbine disc for the turbine wheel of FIG. 1. FIGS. 6 and 7 are end and side views of a blade retainer clip for the turbine wheel of FIG. 1 according to a first embodiment. FIG. 8 is a side view of the turbine blade of FIGS. 2 and 3 with the blade retainer clip of FIGS. 6 and 7. FIG. 9 is a side view of the turbine blade of FIGS. 2 and 3 with the blade retainer clip of FIGS. 6 and 7 inserted into the turbine disc of FIGS. 4 and 5. FIGS. 10 and 11 are end and side views of a blade retainer clip according to a second embodiment. FIGS. 12 and 13 are end and side views according to a third embodiment. FIGS. 14 and 15 are end and side views according to a fourth embodiment.

FIG. 1 is an end view of a turbine wheel 2 that may incorporate at least one possible embodiment. The turbine wheel 2 includes a turbine disc 4 and multiple turbine blades 6. The turbine disc 4 receives a root or foot 8 of each turbine blade 6 in a corresponding slot or shoe 10 along the periphery of the turbine disc 4. A blade retainer clip 12 for each turbine blade 6 secures the foot 8 of each turbine blade 6 in its respective shoe 10.

Referring to FIGS. 2 and 3 together, the foot 8 of each turbine blade 6 has a mating slot 14 that extends along a bottom 16 of the turbine blade foot 8 from a toe 18 of the turbine blade foot 8 to a heel 20 of the turbine blade foot 8. The mating slot 14 has a cavity or mating recess 22 along a central portion of the mating slot 14. Referring to FIGS. 4 and 5 together, each shoe 10 of the turbine disc 4 has a toe 24 and a heel 26.

Referring to FIGS. 6 and 7 together, the blade retainer clip 12 according to a first embodiment includes a clip shank 28 that fits into the turbine blade foot mating slot 14, a protuberance 30 that fits into the mating recess 22 of the turbine blade foot mating slot 14, a clip heel 32 on one end of the clip shank 28 that expands radially from at least opposite sides of the clip shank 28 and a deformable clip toe 34 on the other end of the clip shank 28. In this embodiment, the clip heel 32 has the form of a button or knob and the protuberance 30 has the form of a bend or fold in the clip shank 28.

Referring to FIG. 8, the blade retainer clip 12 mounts in the turbine blade foot 8 so that the clip shank 28 fits in the mating slot 14 and the protuberance 30 fits in the mating slot recess 22. The clip heel 32 engages the turbine blade foot heel 20 and the deformable clip toe 34 extends beyond the turbine blade foot toe 18. Referring to FIG. 9, the turbine blade foot toe 18 and the blade retainer clip toe 34 together slip into the turbine disc heel 26 until the turbine blade foot toe 18 is flush with the turbine disc shoe toe 24, which engages the clip heel 32 with the turbine disc shoe heel 26 as well as the turbine blade foot heel 20. Bending the clip toe 34 over to engage the turbine disc shoe toe 24 then locks the turbine blade 6 securely in the turbine disc 4. Since the clip heel 32 engages the turbine blade foot heel 20 and the turbine disc shoe heel 26 on opposite sides of the clip shank 28, the blade retainer clip 12 is resistant to deformation that would result in the turbine blade foot 8 walking in its turbine disc shoe 10 toward the turbine disc shoe toe 24 under load.

Referring to FIGS. 10 and 11 together, the blade retainer clip 12 according to a second embodiment has the clip heel 32 expanding radially from one end of the clip shank 28 in the form of a cleat that is generally parallel to the turbine blade 6. Because the clip heel 32 again engages the turbine blade foot heel 20 and the turbine disc shoe heel 26 on opposite sides of the clip shank 28, the blade retainer clip 12 according to this embodiment is also resistant to deformation that would result in the turbine blade foot 8 walking in its disc shoe 10 toward the disc shoe toe 24 under load.

Referring to FIGS. 12 and 13 together, the blade retainer clip 12 according to a third embodiment has the clip heel 32 expanding radially from one end of the clip shank 28 in the form of a cleat that is generally transverse to the turbine blade 6. It too engages the turbine blade foot heel 20 and the turbine disc shoe heel 26 on opposite sides of the clip shank 28, and therefore the blade retainer clip 12 according to this embodiment is also resistant to deformation that would result in the turbine blade foot 8 walking in its turbine disc shoe 10 toward the turbine disc shoe toe 24 under load.

Referring to FIGS. 14 and 15 together, the blade retainer clip 12 according to a fourth embodiment has the clip heel 32 expanding radially from one end of the clip shank 28 in the form of a foot with multiple toes 36. It too engages the turbine blade foot heel 20 and the turbine disc shoe heel 26 on opposite sides of the clip shank 28, and therefore the blade retainer clip 12 according to this embodiment is also resistant to deformation that would result in the turbine blade foot 8 walking in its turbine disc shoe 10 toward the turbine disc shoe toe 24 under load. Although FIG. 14 shows three of the toes 36 arranged at 120 degree angles relative to each other with one of the toes 36 in an upward vertical position, alternately any number of the toes 36 in alternate orientations may be suitable. For example, the orientation of the toes 36 may have a rotation of approximately 180 degrees from that shown in FIG. 14 so that one of the toes 36 is in a downward vertical position. As shown in this embodiment, the protuberance 30 may be a simple solid projection from the clip shank 28 rather than a fold in the clip shank 28. Likewise, the other embodiments of the blade retainer clip 12 as described may also have the protuberance 30 in the form of a solid projection from the clip shank 28.

The clip heel 32 may have different dimensions, either larger or smaller, than the Figures show it in the described embodiments to contact a greater or lesser surface area of the turbine blade foot heel 20 and the turbine disc shoe heel 26. Also, although the Figures show the clip heel 32 shown in the described embodiments as approximately centred on the heel end of the clip shank 28, alternatively the clip heel 32 may mount in an offset position on the heel end of the clip shank 28 to secure a greater contact area on any desired portions of the turbine blade foot heel 20 and the turbine disc shoe heel 26.

The described embodiments as set forth herein represents only some illustrative implementations of the invention as set forth in the attached claims. Changes and substitutions of various details and arrangement thereof are within the scope of the claimed invention.

The invention claimed is:

1. A blade retainer clip for retaining a foot of a turbine blade in a shoe of a turbine disc of a turbine wheel that comprises:

a clip shank that fits into a mating slot in the blade foot;

a protuberance along a central portion of the clip shank that fits into a mating recess along the mating slot in the blade foot;

a clip heel on one end of the clip shank that engages a heel of the blade foot and a heel of the disc shoe that expands radially from the clip shank in the form of a foot with at least three toes displaced about the perimeter of the clip shank; and a clip toe that extends beyond a toe of the disc shoe that is deformable to contact at least the toe of the disc shoe.

2. The blade retainer clip of claim 1, wherein the clip heel that expands radially from the clip shank is a foot with three toes.

3. The blade retainer clip of claim 1, wherein the protuberance is a fold in the clip shank.

4. The blade retainer clip of claim 1, wherein the protuberance is a solid projection from the clip shank.

5. A turbine wheel that comprises:

a turbine disc with multiple shoes about its periphery, each shoe having a toe end and a heel end;

multiple turbine blades, each turbine blade having a foot with a toe end and a heel end, a slot in the foot that extends from the toe end and the heel end with a mating recess intermediate the toe end and the heel end and each turbine blade having its blade foot toe end inserted through a heel end of a corresponding turbine disc shoe; and multiple blade retainer clips, each retainer clip comprising a clip shank that fits into the slot of the blade foot for a corresponding one of the turbine blades, a protuberance along a central portion of the clip shank that fits into the mating recess along the slot in the blade foot, a clip heel on one end of the clip shank that expands radially from the clip shank in the form of a foot with at least three toes displaced about the perimeter of the clip shank to engage a heel of the blade foot and a heel of the disc shoe and a clip toe that extends beyond a toe of the disc shoe that engages at least the toe of the disc shoe.

6. The turbine wheel of claim 5, wherein the clip heel of each clip shank is a foot with three toes.

7. The turbine wheel of claim 5, wherein the protuberance along the clip shank is a fold in the clip shank.

8. The turbine wheel of claim 5, wherein the protuberance along the clip shank is a solid projection from the clip shank.

9. A turbine wheel that comprises:

a turbine disc with multiple shoes about its periphery, each shoe having a toe end and a heel end;

multiple turbine blades, each turbine blade having a foot with a toe end and a heel end, a slot in the foot that extends from the toe end and the heel end with a mating recess intermediate the toe end and the heel end and each turbine blade having its blade foot toe end insert through a heel end of a corresponding turbine disc shoe; and multiple blade retainer clips, each retainer clip comprising a clip shank that fits into the slot of the blade foot for a corresponding one of the turbine blades, a protuberance along a central portion of the clip shank in the form of a fold in the clip shank that fits into the mating recess along the slot in the blade foot, a clip heel in the form of a knob that expands radially from the clip shank in the form of a foot with at least three toes displaced about the perimeter of the clip shank to engage a heel of the blade foot and a heel of the disc shoe and a clip toe that extends beyond a toe of the disc shoe that engages at least the toe of the disc shoe.

* * * * *